United States Patent [19]

Stewart et al.

[11] Patent Number: 5,025,871

[45] Date of Patent: Jun. 25, 1991

[54] DRILLING METHOD AND ROTARY DRILL BIT CROWN

[76] Inventors: Aulette Stewart, 45 Arend Avenue, Randburg, Transvaal, South Africa; Ian E. Clark, 24 Silver Drive, Camberley, Surrey, England

[21] Appl. No.: 504,567

[22] Filed: Apr. 4, 1990

[30] Foreign Application Priority Data

Apr. 5, 1989 [GB] United Kingdom ..... 8907618

[51] Int. Cl.[5] ..... E21B 10/02; E21B 10/46; E21B 10/48

[52] U.S. Cl. ..... 175/57; 175/329; 175/330; 175/410

[58] Field of Search ..... 175/410, 409, 379, 57, 175/329, 330

[56] References Cited

U.S. PATENT DOCUMENTS

| | | | |
|---|---|---|---|
| 3,726,351 | 4/1973 | Williams, Jr. | 175/410 |
| 4,162,900 | 7/1979 | Judd | 51/295 |
| 4,190,126 | 2/1980 | Kabashima | 175/410 |
| 4,373,593 | 2/1983 | Phaal et al. | 175/410 X |
| 4,440,246 | 4/1984 | Jürgens | 175/410 X |
| 4,499,959 | 2/1985 | Grappendorf et al. | 175/410 X |
| 4,602,691 | 7/1986 | Weaver | 175/410 X |

FOREIGN PATENT DOCUMENTS

| | | |
|---|---|---|
| 0101096 | 2/1984 | European Pat. Off. . |
| 0154936 | 9/1985 | European Pat. Off. . |
| 0156235 | 10/1985 | European Pat. Off. . |
| 2238387 | 3/1974 | Fed. Rep. of Germany . |
| 2620487 | 3/1989 | France . |

OTHER PUBLICATIONS

Polykristalline Diamantverbundstoffe als Schneideinsätze für Drehbohrwerkzeuge im Berghau, from Glückauf Forschungshefte, vol. 48, No. 6, Dec. 6, 1987, pp. 289–297.

*Primary Examiner*—Stephen J. Novosad
*Attorney, Agent, or Firm*—Scully, Scott Murphy & Presser

[57] ABSTRACT

A rotatable crown for a rotary drill comprising a working end and an opposite end for engagement in a drill rod, stringer or adaptor coupling, the working end having a cutting face and a plurality of discrete, spaced, elongate cutting elements located in the cutting face, each cutting element:

(1) being of square or rectangular cross-section;
(2) presenting a cutting point which is defined by a corner of the element;
(3) having a longitudinal axis which extends behind the cutting face; and
(4) being made of thermally stable abrasive compact.

The crown has particular application for the drilling of substrates having a compressive strength of at least 180 MPa such as Paarl granite, Norite Gabbro and Reef Quartzite.

7 Claims, 3 Drawing Sheets

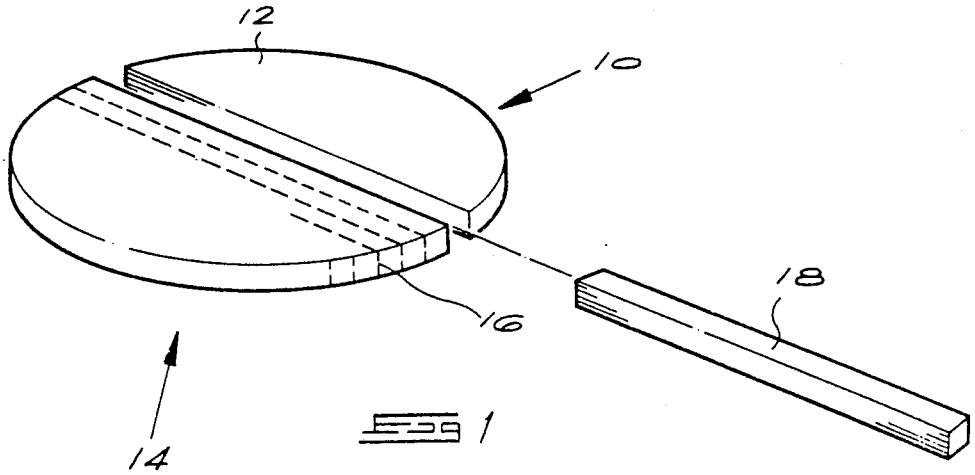
FIG 1
FIG 2
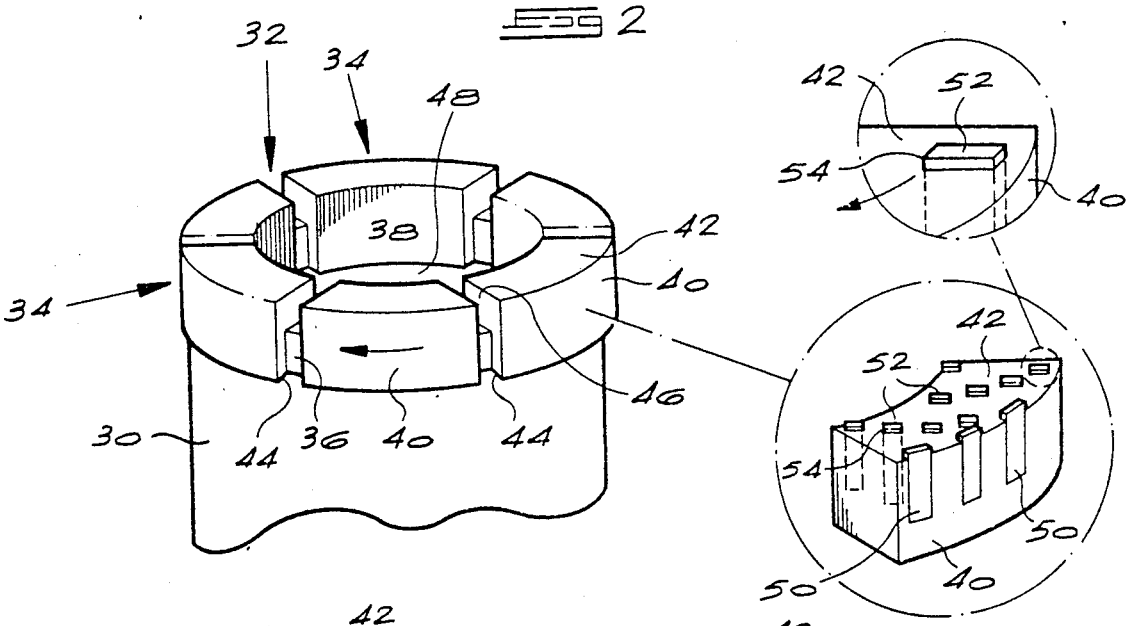
FIG 3
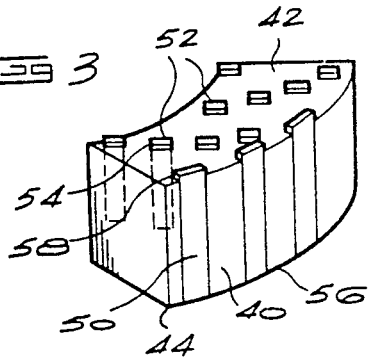
FIG 4
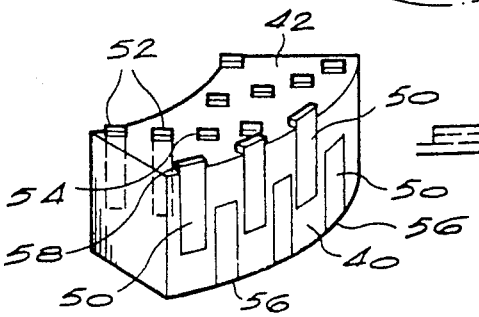

DRILLING METHOD AND ROTARY DRILL BIT CROWN

BACKGROUND OF THE INVENTION

This invention relates to drilling, drill bits and abrasive elements for use in such bits.

Rotary drills comprise a rotatable crown having one end threaded for engagement in the drill rod, stringer or adaptor coupling, and a working portion or cutting face at the other end. The working portion comprises a plurality of cutting elements firmly held in a suitable bonding matrix. The bonding matrix may contain an alloy such as bronze cementing together hard particles such as WC, Fe, or W.

The cutting elements may be made of a variety of hard material such as diamond, cemented carbide and abrasive compacts.

Abrasive compacts, as is known in the art, consist essentially of a mass of abrasive particles present in an amount of at least 70 percent, preferably 80 to 90 percent by volume, of the compact bonded into a hard conglomerate. Compacts are polycrystalline masses containing a substantial amount of direct particle-to-particle bonding. The abrasive particles of compacts are invariably ultra-hard abrasives such as diamond and cubic boron nitride. Diamond compacts are also known in the art as polycrystalline diamond or PCD.

Diamond compacts which are thermally stable at temperatures above 700° C. are known in the art and are used, for example, as the cutting elements in rotary drills. Examples of such compacts are described in U.S. Pat. Nos. 4,534,773, 4,793,828 and 4,224,380. Such cutting elements have generally been provided in the form of cubes or equilateral triangles which are suitably mounted in the cutting face of the rotatable crown of a drill so as to present a cutting point or edge.

European Patent Publication No. 0156235 describes and claims a diamond cutter insert for use in a drill bit which comprises a plurality of thermally stable polycrystalline diamond cutting elements each characterised by a longitudinal axis and held in a matrix material in such manner that the longitudinal axes of the elements are generally mutually parallel. The cutter insert may be mounted on the end of a stud for insertion into a drill bit body. Alternatively, the cutter insert may be bonded directly into the cutting face of a drill bit. The individual polycrystalline diamond cutting elements are said to be capable of having a length of up to 10 mm.

European Pat. No. 0101096 describes a method of producing a plurality of inserts suitable for drills or drill bits including the steps of providing a disc-shaped abrasive compact and severing the compact along planes which are transverse to the flat surfaces of the disc to produce the inserts.

U.S. Pat. No. 4,190,126 describes a rotary abrasive drilling bit comprising a plurality of cutting elements held in a bonding matrix in a working face of the bit, each element comprising a stick-like body of cemented tungsten carbide which presents a curved cutting edge. The drill bit is said to be useful in drilling rock which is of relatively soft formation or semi-hard formation. The drill bit would not be suitable for drilling hard rock formations.

SUMMARY OF THE INVENTION

According to the present invention, there is provided a rotatable crown for a rotary drill comprising a working end and an opposite end for engagement in a drill rod, stringer or adaptor coupling, the working end having a cutting face and a plurality of discrete, spaced, elongate cutting elements located in the cutting face, each cutting element:

(1) being of square or rectangular cross-section;

(2) presenting a cutting point which is defined by a corner of the element;

(3) having a longitudinal axis which extends behind the cutting face; and (4) being made of thermally stable abrasive compact.

The longitudinal axis may lie substantially normal to the cutting face or at a positive or negative rake angle relative thereto.

Further according to the invention, a method of drilling a substrate having a compressive strength of at least 180 MPa includes the steps of providing a rotatable crown as described above, rotating the crown, contacting the substrate with the rotating crown such that the cutting points of the cutting elements abrade the substrate, and advancing the rotating crown into a substrate.

The cutting elements used in the rotatable crown described above may be made by a method which includes the steps of providing a disc-shaped abrasive compact having major flat surfaces on each of opposite sides thereof, severing the abrasive compact along planes such that a plurality of rod-like elements are produced, each element having a longitudinal axis which lies in a plane which is in a major flat surface or parallel to such major flat surface, and optionally cutting each rod-like element into two or more shorter elements.

DESCRIPTION OF THE DRAWINGS

FIG. 1 shows a disc-shaped abrasive compact being severed into a plurality of rod-like elements;

FIG. 2 illustrates a perspective view of a rotatable crown of the invention;

FIG. 3 illustrates a second type of segment for a rotatable crown of the invention;

FIG. 4 illustrates a third type of segment for a rotatable crown of the invention.

DESCRIPTION OF EMBODIMENTS

Figure 6:
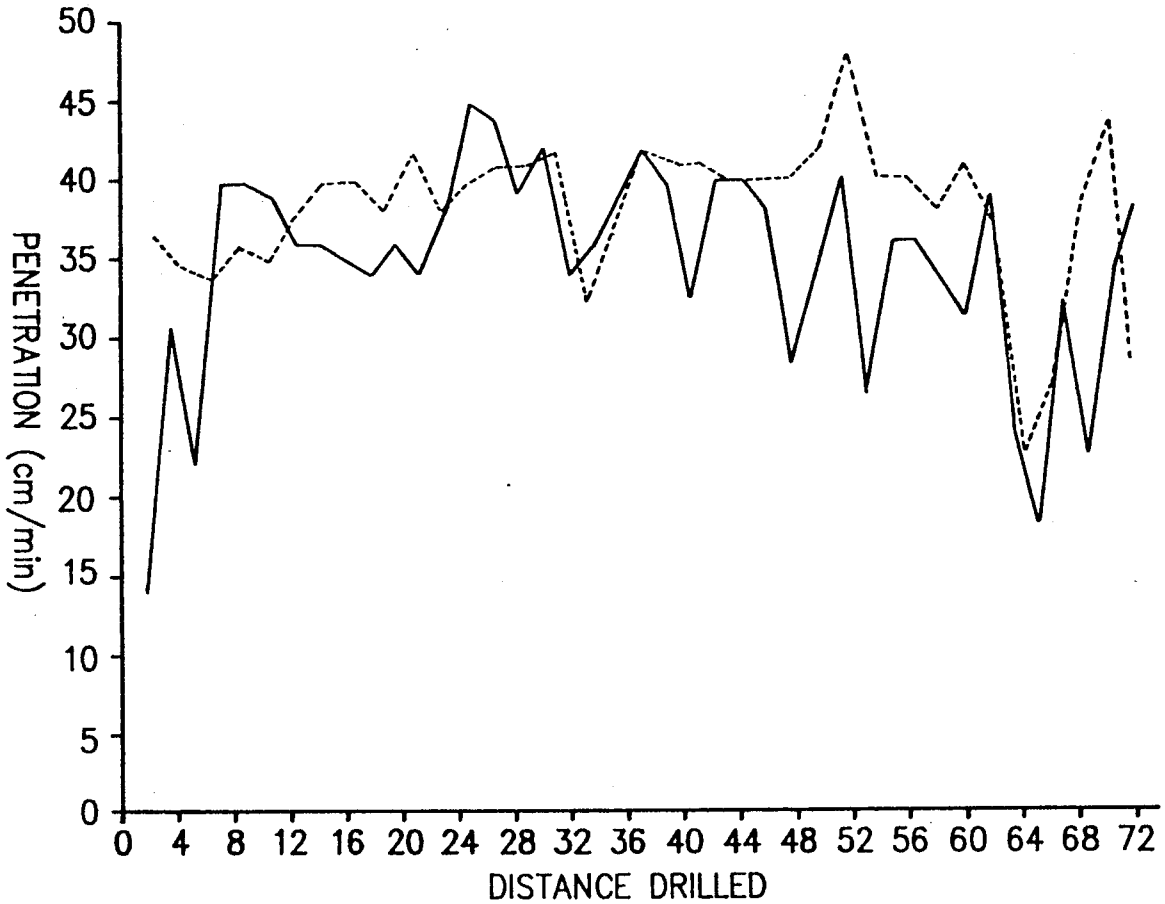
FIG. 6 is a graph showing penetration rates for two types of rotatable crowns.

The abrasive compact of the elongate cutting elements is a thermally stable diamond compact. Thermally stable diamond compacts are diamond compacts which will not degrade to any significant extent when exposed to temperatures of the order of 1200° C. in a vacuum, or inert or reducing atmosphere. An example of a particularly suitable thermally stable diamond compact is that described in U.S. Pat. No. 4,793,828.

The cutting elements will typically have a length of at least 4 mm. They can have lengths exceeding 10 mm. Such cutting elements, i.e. elements having a length of greater than 10 mm are believed to be new products.

The cross-section of the cutting elements are square or rectangular. Further, the elements provide a cutting point which is defined by a corner of the element. This point generally protrudes slightly above the cutting face of the working end. It has been found that a cutting point provides far better cutting action for the crown than an elongate cutting edge, a flat cutting surface, a curved cutting edge or curved cutting surface. The cross-section of the element should be as small as possible. Preferably, the largest linear dimension of the square or rectangle does not exceed 2.5 mm, more preferably does not exceed 1.5 mm.

The working end of the drill crown preferably comprises a plurality of segments each of which has a curved inner surface and a curved outer surface and a top cutting face joining these two curved surfaces, the top cutting face having located therein a plurality of discrete, spaced, elongate cutting elements as described above and the outer curved surface having a plurality of discrete, spaced, cutting elements of the type described above located therein which act as gauge stones and at least some of the cutting elements located in this outer surface presenting a lower cutting edge. The cutting elements which act as cutting gauge stones can extend from the flat top cutting face to the lower cutting edge.

The drill crown of the invention has application for the drilling of hard substrates, particularly those which have a compressive strength of at least 180 MPa, preferably at least 220 MPa. Examples of such substrates are Paarl granite, Norite Gabbro and Reef Quartzite.

Embodiments of the invention will now be described with reference to the accompanying drawings. FIG. 1 illustrates a disc-shaped thermally stable abrasive compact 10 having major flat surfaces 12, 14 on each of opposite sides thereof. The abrasive compact is cut along a series of spaced planes 16 which are perpendicular to the flat surfaces 12, 14 to produce a plurality of rod-like monolithic elements 18. Each rod-like element can be cut into two or more shorter elements.

It will be noted that cutting of the disc is such that the longitudinal axis of each element lies in the plane of a major flat surface. It is possible to produce abrasive compacts having diameters of up to 58 mm or more. Consequently, it is possible to produce with this method rod-like elements of up to 58 mm or more in length.

Cutting of the compact may be achieved by methods known in the art such as laser or spark erosion cutting.

A plurality of the rod-like elements produced in the manner described above may be mounted in the working end of a drill crown in the manner illustrated by FIG. 2. Referring to this figure, there is shown a rotatable crown 30 suitable for coupling with a rotary drill rod, stringer or adaptor coupling. The crown 30 has a working end 32 and an opposite end (not shown) for engagement in the rotary drill rod, stringer or adaptor coupling. The opposite end which engages a rotary drill rod, stringer or adaptor is a standard configuration and may, for example, be threaded. The working end 32 comprises a plurality of segments 34 bonded to an end 36 of the crown. Each segment has a curved inner surface 38 and a curved outer surface 40 and a flat top surface 42. There is also a lower flat lip 44 on each segment. Grooves 46 are provided between adjacent segments and allow liquid or air for cooling and flushing to pass from the hollow centre 48 of the crown to the outside or vice versa. These grooves allow liquid or air for cooling and flushing to pass from the hollow centre 48 of the crown, to the outside or vice versa.

As can be seen from the one enlarged segment, partially embedded in the flat surface 42, which provides the cutting face, are a number of elongate cutting elements 50 each of which has a longitudinal axis. Each element is so embedded in the surface 42 that it presents an exposed substantially flat rectangular surface 52 and the longitudinal axis is substantially normal to the flat surface 42. The corners 54 of rectangular surfaces 52 provides the cutting edges for the cutting face and hence for the drill crown. The cutting elements 50 which are located in the inner and outer curved surfaces 38 and 40 serve a dual function—they act as gauge stones as well as cutting elements. It will be noted that a flat elongate face of the element lies in the curved surface 40 and that, for this edge element a cutting edge 58 is presented. The cutting elements between the curved surfaces 38, 40 present cutting points 54.

The drill crown may be manufactured by conventional hot press or infiltration techniques well known in the art.

In use, the drill crown will be rotated in the direction of the arrow illustrated by FIG. 2. Thus, it is the corner 54 which provides the cutting action and this, it has been found, is advantageous particularly when drilling hard substrates having a compressive strength of at least 180 MPa.

FIGS. 3 and 4 illustrate alternative embodiments of segments for use with the drill crown of FIG. 2 and like parts carry like numerals. In the embodiment of FIG. 3, it will be noted that the cutting elements 50 located in the outer curved surface 40 extend from the cutting face 42 to the lower lip 44. Thus, in this embodiment, the gauge stones in this outer surface serve not only as cutting elements and gauge stones for advancement of the drill crown into a substrate, but also as reamers on withdrawal of the drill crown from a substrate. It is the lower cutting edges 56 of these outer elements which provide the necessary cutting or reaming action.

The FIG. 4 embodiment is similar to that of FIG. 3 save that the cutting elements located in the outer curved surface 40 do not extend from the cutting face 42 to the lower lip 44. In this embodiment, the cutting elements in the outer surface 40 are provided in a staggered arrangement with one group presenting lower cutting edges 56 which provide the reaming capabilities of the drill crown.

Figure 5:
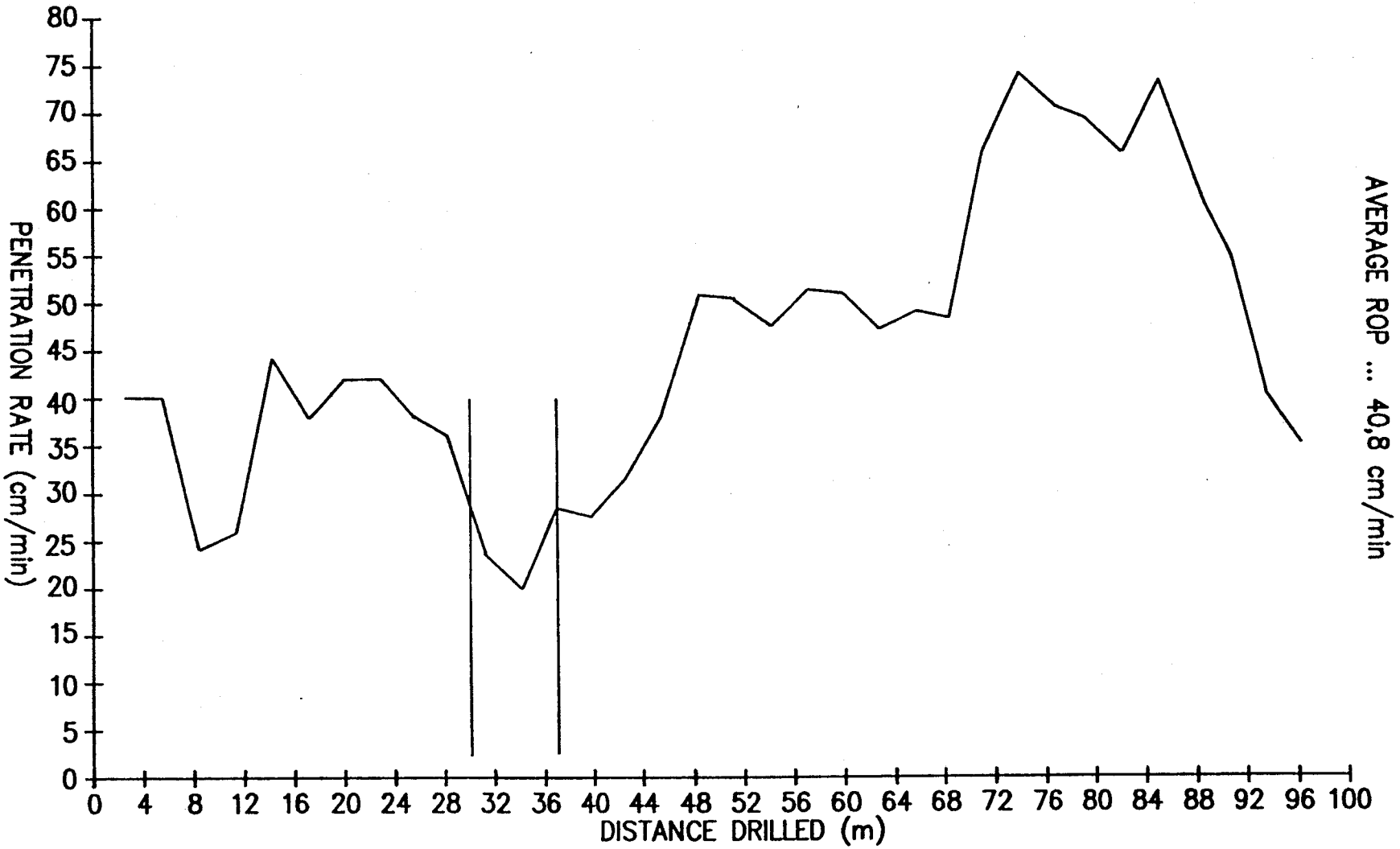
FIG. 5 is a graph showing the penetration rate (ROP) as a function of distance drilled in an embodiment of the invention.

A rotary drill using the rotatable crowns as described in FIG. 2 and incorporating elongate cutting elements each having a length of 4 mm and made of a thermally stable diamond compact of the type described in U.S. Pat. No. 4,793,828 was tested in the drilling of Norite granite. The rate of penetration was determined in relation to the distance drilled in the granite. The results obtained are set out graphically in FIG. 5. The following points may be made on these results:

1. The drill was initially used in a mine at a loading which was varied between 1550 to 2100 kg and a rotational speed of 900 rpm. The average rate of penetration was 35.4 cm/min.
2. Thereafter, the parameters such as loading and rotational speed were varied. This experimentation showed that the optimum loading was 1680 kg and a rotational speed of 1100 rpm.
3. Thereafter, Norite granite was drilled in the laboratory to a further depth of 61 meters producing an average rate of penetration of 53.29 cm/min. Such a rate of penetration is extremely good and considerably higher than that obtained during the earlier stages of drilling.
4. Visual examination of the core at the end of the experiment showed that the individual elements had worn to a length of approximately 2 mm. This represents a small wear bearing in mind the total distance drilled of 96.5 meters.

A similar test was carried out on Paarl granite, a harder granite, and an average penetration rate of 30 cm/min was achieved. Again the actual penetration rate increased with time.

The elongate cutting elements have several advantages over the cubes and triangles which have been used in the past. These advantages are:

1. With a cube or triangle, the cutting element has an effective life only until it has been worn to half its original size. With the elongate cutting elements, drilling can be continued until virtually the entire pin has been consumed.
2. With the elongate cutting elements, the bit loading is constant since throughout the life of the bit, i.e. the contact area of the elements with the substrate being drilled remains constant. The contact area of both cubes and triangles increases with wear and therefore the forces required to drill increase with time.
3. The elongate cutting elements can act both a gauge stones and cutting elements simultaneously obviating the need for kicker stones and cemented carbide wear strips—thereby reducing costs.
4. The elongate cutting element is more robust as there is less element protrusion above the cutting face and therefore less likelihood of damage to the element if dropped down a hole or handled roughly.
5. Enhanced performance over impregnated bits as well as surface set bits. It is possible to achieve the life-time advantage of an impregnated bit while also getting the "constant" exposure of a surface set bit.

FIG. 6 illustrates graphically the penetration rate profiles of two rotatable drill crowns over a distance of 71.6 meters drilled. Bit A is a crown according to FIG. 1 while Bit B is a similar crown having the same cutting elements except an elongate side, as opposed to a corner, of rectangle 52 between the two curved surfaces (38, 40) was presented for cutting. It will be noted that the profiles are similar. However, for the Bit A a load of only 1680 kg was required compared with a load of 1933 kg required for Bit B. The higher load results in more wear of the cutting elements and more power consumed.

We claim:

1. A rotatable crown for a rotary drill comprising a working end and an opposite end for engagement in a drill rod, stringer or adaptor coupling, wherein the working end comprises a plurality of segments each of which has a curved inner surface and a curved outer surface and a top cutting face joining these two curved surfaces, the top cutting face having located therein a plurality of discrete, spaced, elongate cutting elements, and the outer curved surface having located therein a plurality of discrete, spaced, cutting elements which act as gauge stones, each of the cutting elements:

(i) being of square or rectangular cross-section;

(ii) presenting a cutting point which is defined by a corner of the element;

(iii) having a longitudinal axis which extends behind the cutting face; and (iv) being made of thermally stable abrasive compact; and at least some of the cutting elements located in the outer surface presenting a lower cutting edge.

2. A rotatable crown of claim 1 wherein the cutting elements have a length of at least 4 mm.

3. A rotatable crown according to claim 1 wherein the cutting elements have a length exceeding 10 mm.

4. A rotatable crown according to claim 1 wherein the largest linear dimension of the square or rectangle of the cross-section of the element does not exceed 2.5 mm.

5. A rotatable crown according to claim 1 wherein the largest linear dimension of the square or rectangle of the cross-section of the element does not exceed 1.5 mm.

6. A rotatable crown according to claim 1 wherein the cutting elements which act as gauge stones extend from the top cutting face to the lower cutting edge.

7. A method of drilling a substrate having a compressive strength of at least 180 MPa including the steps of:

providing a rotatable crown comprising a working end including a plurality of segments each of which has a curved inner surface, a curved outer surface, and a top cutting face joining these two curved surfaces, the top cutting face having located therein a plurality of discrete, spaced, elongate cutting elements, and the outer curved surface having located therein a plurality of discrete, spaced, cutting elements, each of the cutting elements (1) being of square or rectangular cross-section, (2) presenting a cutting point which is defined by a corner of the element, (3) having a longitudinal axis which extends behind the cutting face, and (4) being made of thermally stable abrasive compact;

rotating the crown;

contacting the substrate with the rotating crown such that the cutting points of the cutting elements abrade the substrate;

advancing the rotating crown into the substrate;

using cutting elements in the outer curved surface as gauge stones;

withdrawing the crown from the substrate; and employing lower edges of at least some of the cutting elements in the outer curved surface as cutting edges during the withdrawing step to cut the substrate.

* * * * *